United States Patent [19]

Acosta

[11] 4,168,816

[45] Sep. 25, 1979

[54] AIRPLANE SHAPED KITE

[76] Inventor: Miguel B. Acosta, 403 N. New Hampshire #403, Los Angeles, Calif. 90004

[21] Appl. No.: 903,105

[22] Filed: May 5, 1978

[51] Int. Cl.[2] ..... B64C 31/06

[52] U.S. Cl. ..... 244/154

[58] Field of Search ..... 244/154, 153 R; D34/15 AF; 46/76 R, 77, 79; 40/212, 214, 542

[56] References Cited

U.S. PATENT DOCUMENTS

| | | | |
|---|---|---|---|
| 1,409,595 | 3/1922 | Sheridan | 40/542 |
| 2,063,961 | 12/1936 | Stoney et al. | 244/154 |
| 2,240,881 | 5/1941 | Bradford | 244/154 |
| 2,391,705 | 12/1945 | Isenberg | 40/542 |
| 3,997,184 | 12/1976 | Riti | 40/542 |

FOREIGN PATENT DOCUMENTS

| | | | |
|---|---|---|---|
| 945738 | 5/1949 | France | 244/154 |

*Primary Examiner*—Barry L. Kelmachter
*Attorney, Agent, or Firm*—Erik M. Arnhem

[57] ABSTRACT

A kite, comprising a substantially arrow-shaped body; a wing framework mounted to and divided by the body into two quadrilateral sections; a cover, respectively spanning loosely across and mounted to two opposite sides of each division of the wing framework, one of the unmounted sides thereof is provided with a reinforcing strip of material; a tail framework mounted to the body; a cover spanning loosely across and mounted at two opposite sides of the tail frame, one unmounted side thereof is provided with a reinforcing strip of material; lengths of strings are mounted to the body of the kite.

6 Claims, 4 Drawing Figures

AIRPLANE SHAPED KITE

BACKGROUND OF THE INVENTION

The invention relates to a kite type device, in the form of an airplane or glider, having a surface of light material stretched over its wing and tail frameworks, in such a manner so as to permit the device to maintain a substantially horizontal flight path, when airborne.

The inventor has no knowledge of prior art in the field of his invention, that substantially resembles the invented airplane shaped kite. Presently known kite type contrivances, generally require a balancing tail, have uncharacteristic appearances and, at any rate, are not intended for horizontal flight paths.

SUMMARY OF THE INVENTION

My invention refers to a concept uniquely different from the classic kite, which, generally speaking, is incapable of flying in a substantially horizontal position.

The device, according to the invention, is built as a glider or airplane; its body is made of light material, e.g., styrene, or even an air inflated fuselage shaped body; its wing and tail sections are mounted in the body, and are loosely covered by thin material, e.g., plastic or fabric, which only partly is fastened to the frameworks of the wings and tails, as will be explained further on in greater detail.

The invented airplace shaped kite is launched substantially as a conventional kite, but—due to its unique construction—maintains a good gliding angle between itself and the horizon subsequent to becoming airborne; it is maintained in a balanced substantially horizontal position in the air, also by means of strings held by its operator.

The invention may be utilized as a toy, in sports, for advertising or other utilitarian purposes.

It is thus an object of the invention to provide a kite, shaped as a glider or airplane.

It is a further object of the invention to provide such a kite, which, when launched, will soar quickly and thereafter maintain a horizontal path in the air.

It is still a further object of the invention to provide an airplane shaped kite, which may be used for recreational or more serious type purposes.

DESCRIPTION OF PREFERRED EMBODIMENTS

Figure 1:
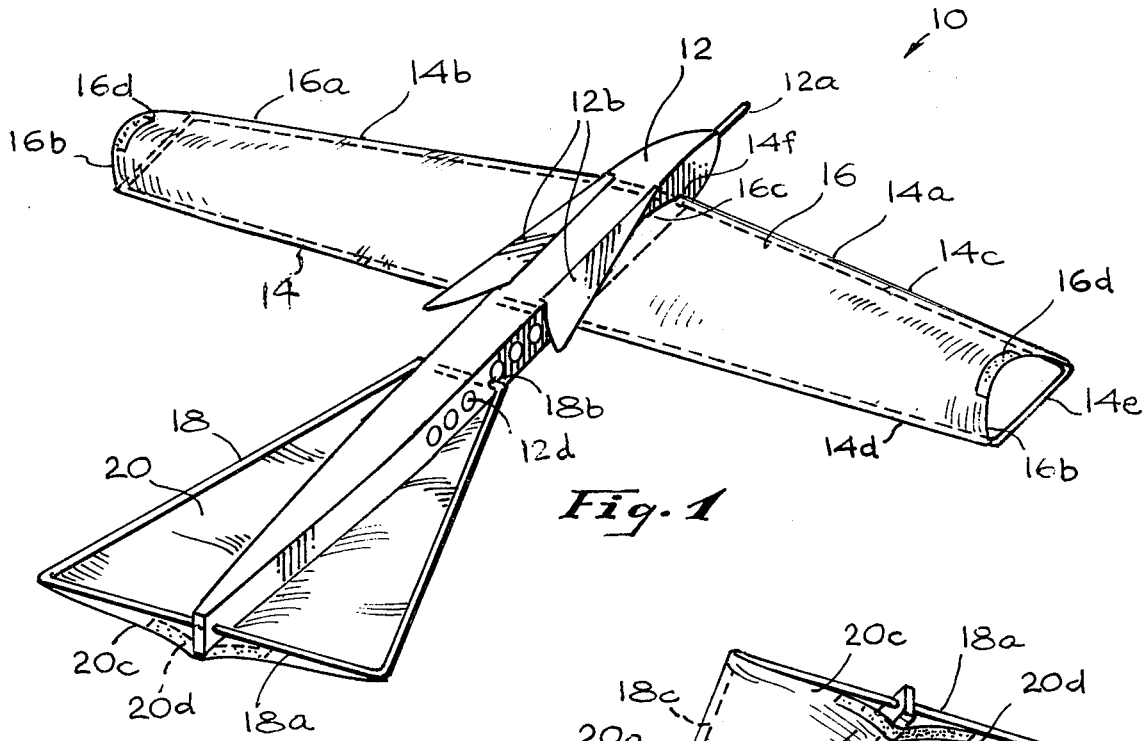
FIG. 1 is a perspective top view of the airplane shaped kite.

In the drawings like reference characters designate similar parts in the several views.

Referring now in detail to the drawings, numeral 10 designates the airplane shaped kite in its entirety.

The body 12 has an upwardly curving, substantially arrow shaped configuration, i.e., with angularly shaped projections emerging rearwardly from its front portion and a narrowing rear section. It is preferably made of lightweight material, such as e.g., styrene or may even consist of an air inflated fuselage shaped plastic cushion.

A rodlet 12*a* is mounted to and projects straight from the front tip of body 12, which, if the plane should be nose diving, may embed the latter vertically in the ground and, thus prevent any damage to the plane on impact.

The framework 14 for the wing sections 14*a,b* may consist of thin rods forming one quadrilateral frame mounted to and passing through the body 12, as indicated by dotted lines (FIG. 1); or two sectional frames inserted separately and oppositely one another therein.

Figure 3:
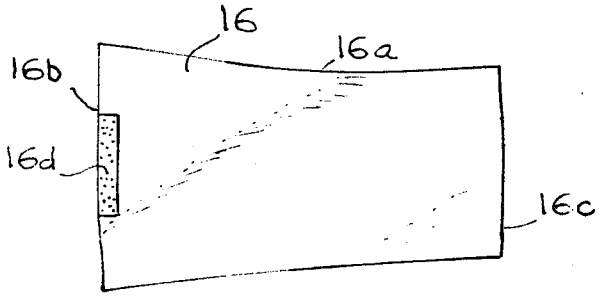
FIG. 3 is a cover for one of the wing sections of the device, in a top view.

A light piece of fabric or plastic cover material 16 (FIG. 3), preferably in the shape of a trapezoid, covers each of wing sections 14*a*, 14*b*. The width of the cover 16 is larger than that of its underlying wing section and is spanned loosely thereover; the long sides 16*a* of cover 16 are, respectively fastened to the front and rear sides 14*c,d* of the wing sections 14*a*, 14*b*, by any appropriate means. The base 16*b*, and opposite side 16*c* of cover 16 are disposed, respectively unattached at the outer ends 14*e*, 14*f*, respectively of the wing sections (14*a,b*). At least a portion of the edge of cover base 16*b* is provided with a strip of cloth, or the like, 16*d*, having the effect of reinforcing cover 16 when exposed to air pressure in flight.

Figure 2:
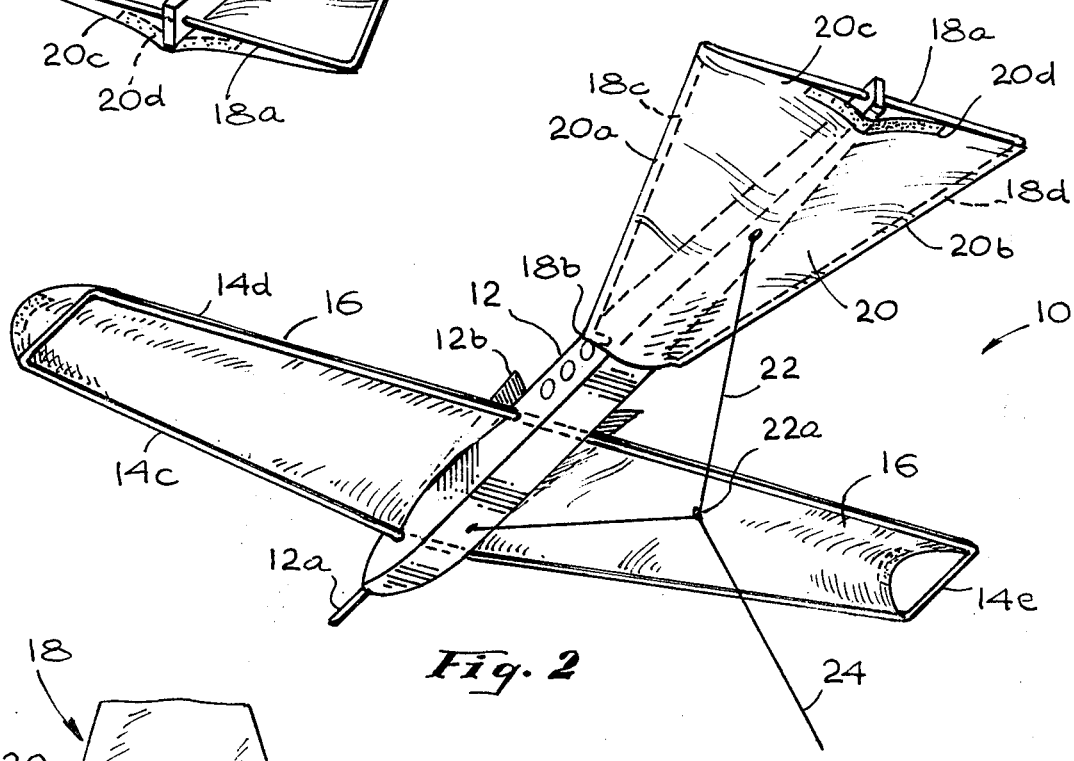
FIG. 2 is a perspective bottom view of the kite device in FIG. 1.
Figure 4:
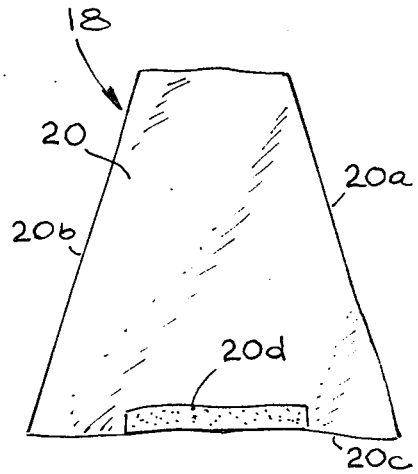
FIG. 4 is a cover for the tail section of the device, in a top view.

FIG. 2 illustrates the airplane seen from the bottom, presenting a full view of its tail framework section 18, which, preferably defines a trapezoid, and consists e.g., of thin rods; the base portion 18*a* thereof is mounted in and passed through the rear end of body 12 by any appropriate means, e.g., inserted within holes drilled into body 12, as indicated at 12*c*.

The short side 18*b* (opposite the base) is similarly mounted i.e., inserted into and passing through a center portion of body 12, adjacent the wing framework 14.

Thus the base portions, 18*a,b* form, together with the two slanting (leg) portions 18*c,d* the tail framework 18; the tail may also be made of two half sections inserted separately and oppositely one another in body 12.

A light piece of cover material 20 (similar to that used for the wing sections), in trapezoidal form and of a larger width than the tail framework 18 covers the latter, spanning loosely thereover, with its (leg) sides 20*a,b* fastened by any appropriate means (gluing, sewing, etc.) to the corresponding slanting sides 18*c,d*, of tail section 18; only a center portion of base 20*c* of cover 20 is fastened (by gluing, riveting, etc.) to a point on the rear end of body 12, the remaining length of base 20*c*, divided by body 12, being unmounted; the edge of base 20*c* of cover 20 is provided with a narrow strip of material 20*d*, in order to reinforce cover material 20 exposed to air pressure when airborne. The cover material 20 extends entirely beneath and covers the bottom surface of body 12, as illustrated on FIG. 2.

The upper surface of the body 12 (FIG. 11) is bilaterally provided with arrow type projections 12*b*, constituting—in addition to its aerodynamic values—abutting surfaces for the edges of the unattached sides 16*c* of the two wing covers 16. When the plane is airborne and air pressure causes the wing covers 16 to bulge upwardly, the edges of cover sides 16*c* will lie against projections 12*b*, and effectively prevent air passing therebetween. The outer end of cover 16, i.e. base 16*b* will then form a V-shaped opening with the underlying portion 14*e* of wing framework 14, and permit air to pass therethrough, thus improving the position of the plane in flight.

The tail section 18 with its mounted cover sides 20*a,b* and unattached side portions 20*c* will, under the circumstances described above, also bulge and—similar to the wing covers—form two V-shaped openings (separated by body 12) with base portions 18*a*.

The upwardly curving of wing and tail covers 16, 20, (normally occurring when the plane loses altitude) will cause the air stream, above the airborne plane to take a longer route and therefore move faster than the air stream going underneath in order to simultaneously therewith reach the trailing edges of the wing and tail. The upper air stream then provides a lower pressure than the lower one and forces the plane again to steady its flight or move upwardly and maintain balanced altitude.

The bulging wing and tail sections of the plane and its curved arrow-shaped body, contribute, separately or in combination, to giving the plane lift and to substantially maintain its balance and horizontal position when airborne.

When air streams force the wing and tail covers 16, 20 to curve upwardly or downwardly, the reinforced strips 16*d,* respectively 20*d,* will be substantially V-formed.

The device is launched, basically in the same manner as a conventional kite. However, the two ends of a rather short string 22 are fastened spatially relatively to one another, on the bottom surface of the plane's body 12, (FIG. 2).

A loop 22*a* is tied in the center of string 22, which may be adjusted to reduce or enlarge the area formed by string (FIG. 2), in order to adjust the kite's balance capabilities prior to launching.

A long string 24 is attached to the loop 22*a,* the end of which is to be held by the operator of the flying plane.

Certain areas of the airplane may be provided with a coat of fluorescent or other luminous agent, which will illuminate same when flying at night. For example, the windows of the plane, as indicated at 12*d* (FIG. 1) may be painted with such agent, or luminous lettering may be printed at any conspicious location on the plane.

While the foregoing has illustrated and described what is now contemplated to be the best mode of carrying out the invention, the above embodiments of my invention are, of course, subject to modifications without departing from the spirit and scope of the invention. Therefore, it is not desired to restrict the invention to the particular constructions illustrated and described but to cover all modifications, that may fall within the scope of the appended claims.

I claim:

1. In an airplane shaped kite, comprising:

(a) a body, having bilaterally extending flanges;

(b) a wing framework mounted in and divided by the body into two trapezoidally shaped wing sections;

(c) two trapezoidally shaped flexible covering means, for covering of the wing sections respectively, being of overall broader width than that of the wing sections, the unparallel sides of said covering means are, respectively fastened along the unparallel sides of the wing sections, base portions and sides opposite from said base portions of said covering means being disposed unmounted, respectively at outer ends of the wing sections, forming a substantially V-shaped opening therewith, and at inner ends of the wing sections, abutting the flanges of the body, when air pressure causes the covering means of the wing sections to bulge upwardly;

(d) a trapezoidally shaped tail framework, a center portion of the base of said tail framework and the side opposite the tail framework base, being respectively, mounted at the rear end of, and at a central point along the body of the kite;

(e) flexible trapezoidally shaped covering means, for covering the tail framework, the overall width of said tail framework covering means being broader than that of the tail framework, the unparallel sides of said tail framework covering means are fastened, respectively to the unparallel sides of the tail framework, a center portion of the base of said tail framework covering means and the side opposite the base are, respectively fastened to the rear end, and disposed unmounted adjacent a center portion, of the body, the unmounted portion of the base of said tail framework covering means forming a substantially V-shaped opening with the base of the tail framework;

(f) controlling means for the kite, mounted to the body.

2. Airplane shaped kite, according to claim 1, wherein reinforcing strips of material are mounted, respectively along length portions of the edges of the base of the covering means covering the wing sections.

3. An airplane shaped kite, according to claim 1, wherein at least one reinforcing strip is mounted along a length portion of the edge of the base of the covering means, covering the tail framework.

4. An airplane shaped kite, according to claim 1, wherein the entire area of the covering means for the tail framework extends underneath the kite body.

5. An airplane shaped kite, according to claim 1, wherein the body has a substantially arrow shaped form.

6. An airplane shaped kite, according to claim 1, wherein a rodlet projects from the front of the body.

* * * * *